US010549338B2

(12) United States Patent
Slavens et al.

(10) Patent No.: US 10,549,338 B2
(45) Date of Patent: Feb. 4, 2020

(54) SYSTEM AND PROCESS TO PROVIDE SELF-SUPPORTING ADDITIVE MANUFACTURED CERAMIC CORE

(71) Applicant: United Technologies Corporation, Farmington, CT (US)

(72) Inventors: Thomas N. Slavens, Norman, OK (US); James T. Auxier, Bloomfield, CT (US)

(73) Assignee: United Technologies Corporation, Farmington, CT (US)

( * ) Notice: Subject to any disclaimer, the term of this patent is extended or adjusted under 35 U.S.C. 154(b) by 0 days.

(21) Appl. No.: 16/214,651

(22) Filed: Dec. 10, 2018

(65) Prior Publication Data

US 2019/0111471 A1 Apr. 18, 2019

Related U.S. Application Data

(62) Division of application No. 15/214,747, filed on Jul. 20, 2016, now Pat. No. 10,179,362.

(51) Int. Cl.

| | |
|---|---|
| ***B22C 9/10*** | (2006.01) |
| ***B22C 9/12*** | (2006.01) |
| ***B22C 9/18*** | (2006.01) |
| ***B22C 9/24*** | (2006.01) |

(52) U.S. Cl.

CPC ..... *B22C 9/10* (2013.01); *B22C 9/12* (2013.01); *B22C 9/18* (2013.01); *B22C 9/24* (2013.01)

(58) Field of Classification Search

CPC .... B22C 9/10; B22C 9/12; B22C 9/18; B22C 9/24

See application file for complete search history.

(56) References Cited

U.S. PATENT DOCUMENTS

| | | | | |
|---|---|---|---|---|
| 6,155,331 | A | 12/2000 | Langer et al. | |
| 7,866,950 | B1 | 1/2011 | Wilson, Jr. | |
| 8,047,789 | B1 | 11/2011 | Liang | |
| 8,057,183 | B1 | 11/2011 | Liang | |
| 8,066,483 | B1 | 11/2011 | Liang | |
| 8,096,766 | B1 | 1/2012 | Downs | |
| 8,109,726 | B2 | 2/2012 | Liang | |
| 8,162,609 | B1 | 4/2012 | Liang | |
| 8,317,475 | B1 | 11/2012 | Downs | |
| 8,322,988 | B1 | 12/2012 | Downs et al. | |
| 2009/0189315 | A1* | 7/2009 | Gunster | B28B 11/243 264/442 |
| 2015/0306657 | A1 | 10/2015 | Frank | |
| 2015/0322799 | A1 | 11/2015 | Xu | |

* cited by examiner

*Primary Examiner* — Kevin P Kerns
*Assistant Examiner* — Steven S Ha
(74) *Attorney, Agent, or Firm* — Bachman & LaPointe, P.C.

(57) ABSTRACT

A core for use in casting an internal cooling circuit within a gas turbine engine component, the core including a core body with an outer skin in which a core body additively manufacturing binder is locally eliminated. A method of manufacturing a core for casting a component, including casting a core body for at least partially forming an internal passage architecture of a component; and forming an outer skin on the core body in which a core body binder is locally eliminated.

7 Claims, 4 Drawing Sheets

SYSTEM AND PROCESS TO PROVIDE SELF-SUPPORTING ADDITIVE MANUFACTURED CERAMIC CORE

CROSS-REFERENCE TO RELATED APPLICATION

The instant application is a divisional application of U.S. patent application Ser. No. 15/214,747 filed Jul. 20, 2016, now issued as U.S. Pat. No. 10,179,362 issued Jan. 15, 2019.

BACKGROUND

The present disclosure relates generally to the utilization of a pre-sintering cycle to a green additive core that will allow the core to be self-supportive during the firing process.

Gas turbine engines, such as those that power modern commercial and military aircraft, generally include a compressor section to pressurize an airflow, a combustor section to burn a hydrocarbon fuel in the presence of the pressurized air, and a turbine section to extract energy from the resultant combustion gases.

Gas turbine engine hot section components such as blades and vanes are subject to high thermal loads for prolonged time periods. Other components also experience high thermal loads such as combustor, exhaust liner, blade outer air seal, and nozzle components. Historically, such components have implemented various air-cooling arrangements that permit the passage of air to facilitate cooling. In addition, the components are typically provided with various coatings such as thermal barrier coatings to further resist the thermal loads.

The internal passage architecture may be produced through various processes such as investment cast, die cast, drill, Electron Discharge Machining ("EDM"), milling, welding, additive manufacturing, etc. Investment casting is a commonly used technique for forming metallic components having complex geometries, especially hollow components, and is used in the fabrication of superalloy gas turbine engine components.

A primary mechanism in which to cool turbine gas path components is to utilize a series of in-wall channels to pass cooling air that is typically several hundreds of degrees colder than the gas path. These walls are typically cast-in to the airfoil and involve designs that distribute cooling air throughout the entirety of the part. The air is subsequently ejected either through film holes or other leakage apertures to the external flowpath environment. The traditional method of fabricating gas path components is to utilize an investment casting process that forms an interior core for the cooling channels. This core is typically a weak ceramic whose strength is significantly less than the component material. This material weakness has allowed for highly quality castings since the core typically collapses or 'crushes' during the solidification process.

The advancement of additive manufacturing to manufacture components provides for extremely detailed, intricate, and adaptive feature designs. The ability to utilize this technology not only increases the design space of the parts but allows for a much higher degree of manufacturing robustness and adaptability. However, the current state-of-the-art in additive manufacturing does not allow for the creation of single crystal materials due to the nature of the process to be built by sintering or melting a powder substrate to form. It is however advantageous for the development die-less cores or the integration of cores and shells for use in the casting process.

A part of processing the additive cores is to burn out the additive manufacturing binder material and sinters the particles together. During this process, the green additive core is placed within an oven and heated. The development of the heating cycle is such that experimentation is conducted to figure out how the cycle should be performed to retain the geometric shape of the part and eliminate sag or deflection of the part. To retain the shape of green cores during the firing process, secondary ceramic parts (typically called setters) are typically created and used to support the core within the chamber. The inclusion of these setters, along with the delicate nature of the cores, may result in significant costs within the development of a new core design.

SUMMARY

A core for use in casting an internal cooling circuit within a gas turbine engine component, the core according to one disclosed non-limiting embodiment of the present disclosure can include a core body with an outer skin in which a core body additively manufacturing binder is locally eliminated.

A further embodiment of the present disclosure may include wherein the outer skin is sintered.

A further embodiment of the present disclosure may include wherein the outer skin of the core body is about 1-2 mils (thousands of an inch).

A further embodiment of the present disclosure may include wherein the core body is investment casted.

A further embodiment of the present disclosure may include wherein the core body includes a ceramic material.

A further embodiment of the present disclosure may include wherein the refractory metal is in a "green" state with the binder.

A further embodiment of the present disclosure may include wherein the outer skin forms only a portion of the outer surface of the core body.

A further embodiment of the present disclosure may include wherein a directional energy source is utilized to form the outer skin.

A further embodiment of the present disclosure may include wherein the outer skin formed only along a line of sight from the directional energy source of the outer surface of the core body.

A further embodiment of the present disclosure may include wherein the core body is fired in a furnace to de-bind and sinter visually shielded regions of the core body.

A further embodiment of the present disclosure may include wherein the outer skin forms only a visible region of the outer surface of the core body and the core body is fired to de-bind and sinter the visually shielded regions of the core body.

A further embodiment of the present disclosure may include wherein the visual regions are along a line of sight from a directional energy source directed at an outer surface of the core body.

A method of manufacturing a core for casting a component according to one disclosed non-limiting embodiment of the present disclosure can include casting a core body for at least partially forming an internal passage architecture of a component; and forming an outer skin on the core body in which a core body additively manufacturing binder is locally eliminated.

A further embodiment of the present disclosure may include using a directional energy source to form the outer skin.

A further embodiment of the present disclosure may include using a laser to form the outer skin.

A further embodiment of the present disclosure may include, wherein the laser is about 100 W.

A further embodiment of the present disclosure may include forming the outer skin only along a line of sight from a directional energy source of the outer surface of the core body.

A further embodiment of the present disclosure may include, wherein the visual regions are along the line of sight from a directional energy source directed at an outer surface of the core body.

A further embodiment of the present disclosure may include firing the core body to de-bind and sinter non-outer skin regions of the core body.

A further embodiment of the present disclosure may include firing the core body to de-bind and sinter visually shielded regions of the core body.

The foregoing features and elements may be combined in various combinations without exclusivity, unless expressly indicated otherwise. These features and elements as well as the operation of the invention will become more apparent in light of the following description and the accompanying drawings. It should be understood, however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
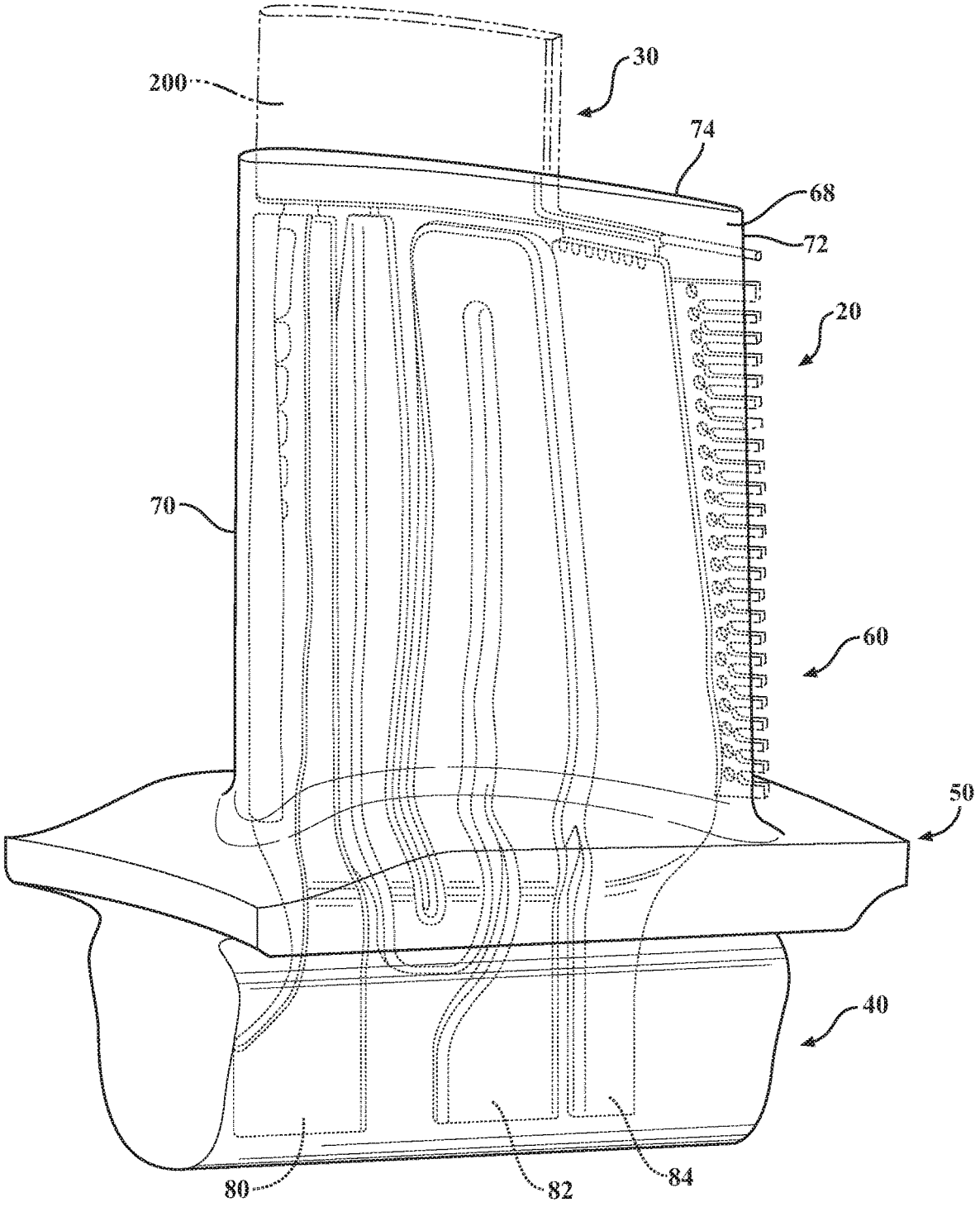
FIG. 1 is a general schematic view of an exemplary actively cooled component as a representative workpiece with an additively manufactured core.

FIG. 1 schematically illustrates a general perspective view of an exemplary component 20, e.g., an actively cooled airfoil segment of a gas turbine engine. It should be appreciated that although a particular component type is illustrated in the disclosed non-limiting embodiment, other components, such as blades, vanes, exhaust duct liners, nozzle flaps, and nozzle seals, as well as other actively cooled components will also benefit herefrom. These components, for example, operate in challenging high-temperature environments such as a hot section of a gas turbine engine and have aggressive requirements in terms of durability and temperature allowances.

Figure 2:
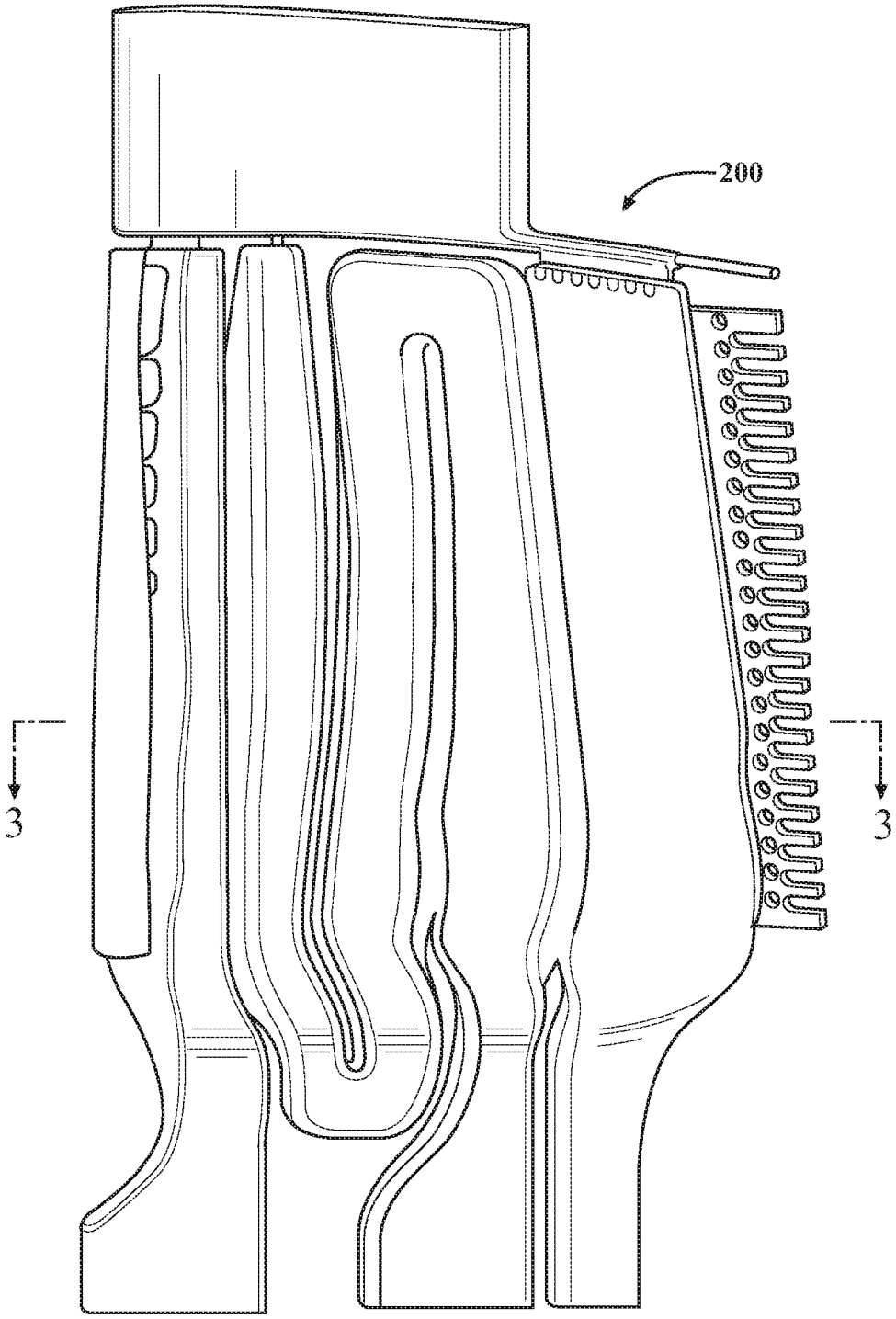
FIG. 2 is a general schematic view of an additively manufactured core.
Figure 3:
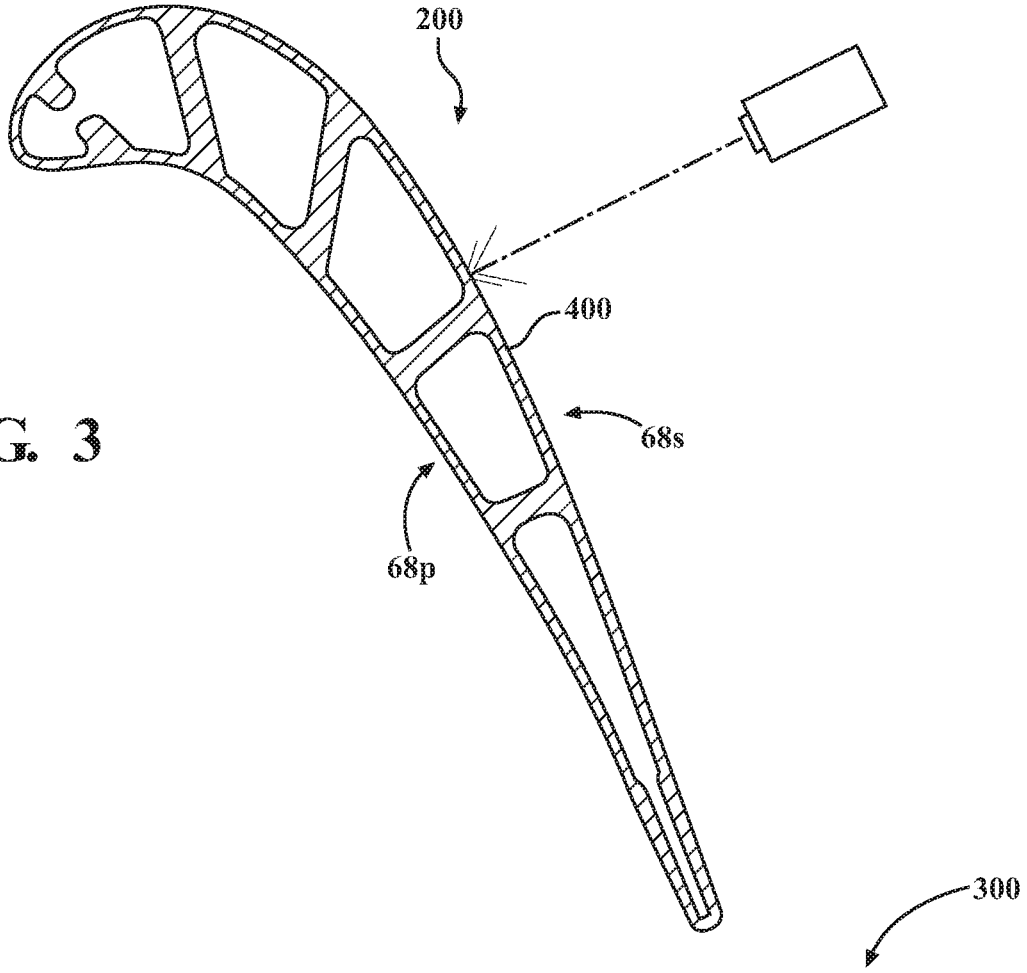
FIG. 3 is an expanded cross section of the additively manufactured core along the line 3-3 of FIG. 2 illustrating the outer skin.

The component 20 includes internal passage architecture 30 formed by a core 200 (FIG. 2). FIG. 3 is an expanded cross-sectional view of the core 32 along the line 3-3 of FIG. 2. The internal passage architecture 30 may include various passages, apertures and features. In this example, the component 20 may be a rotor blade that generally includes a root section 40, a platform section 50 and an airfoil section 60. The airfoil section 60 is defined by an outer airfoil wall surface 68 between a leading edge 70 and a trailing edge 72. The outer airfoil wall surface 68 defines a generally concave shaped portion forming a pressure side 68P and a generally convex shaped portion forming a suction side 68S typically shaped for use in a respective stage of a high pressure turbine section (FIG. 3).

The outer airfoil wall surface 68 extends spanwise from the platform section 50 to a tip 74 of the airfoil section 60. The trailing edge 72 is spaced chordwise from the leading edge 70. The airfoil has a multiple of cavities or passages for cooling air as represented by the supply passages 80, 82, 84 which may extend through the root section 40. The passages extend into the interior of the airfoil section 60 and may extend in a serpentine or other non-linear fashion. It should be appreciated that the passage arrangement is merely illustrative and that various passages may alternatively or additionally be provided.

Figure 4:
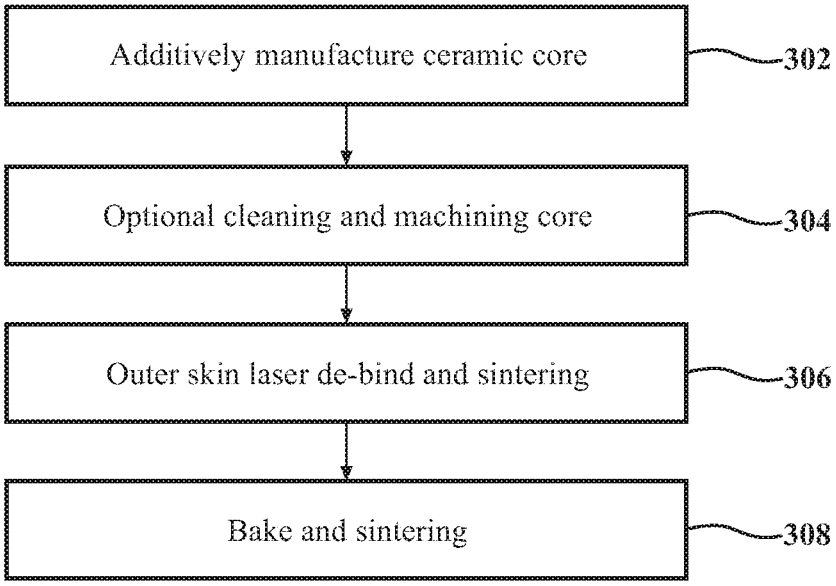
FIG. 4 is a flow diagram of a method of manufacturing a core for casting a component according to a non-liming embodiment.

With reference to FIG. 4, one disclosed non-limiting embodiment of a method 300 to manufacture the core 200 initially includes additively manufacturing the core 200 (Step 302). It should be appreciated that although a particular remanufacture method is depicted, other manufacture, repair, and/or remanufacture processes and methods will also benefit herefrom. The core 200 may be additively manufactured from a ceramic such as silica or alumina and a consumable part off the casting process. In traditional casting processes, the core is created by injection molding of powdered ceramic and binder into a mold. Newer processes have been developed where the ceramic is suspended in a liquid binder than can be solidified using a laser or UV light. This process (called ceramic stereo lithography—CSL) typically utilizes an off-the-shelf lithographic fluid with a traditional ceramic suspended in the solution.

Next, the core 200 may optionally be cleaned or otherwise machined (Step 304). That is, the core 200 may be processed subsequent to the additive manufacturing.

Next, an outer skin 400 of the core 200 is consolidated (Step 306) via, for example, a laser (FIG. 3) prior to full core de-bind and sintering (step 308) in a furnace. Relatively low power lasers, e.g., about 100 W, could be utilized to directly sinter silica. In one example, the silica in the outer skin 400 may be sintered at about 2192 F. The outer skin 400 of the core 200 in this embodiment is about 1-2 mils (thousands of an inch).

Figure 5:
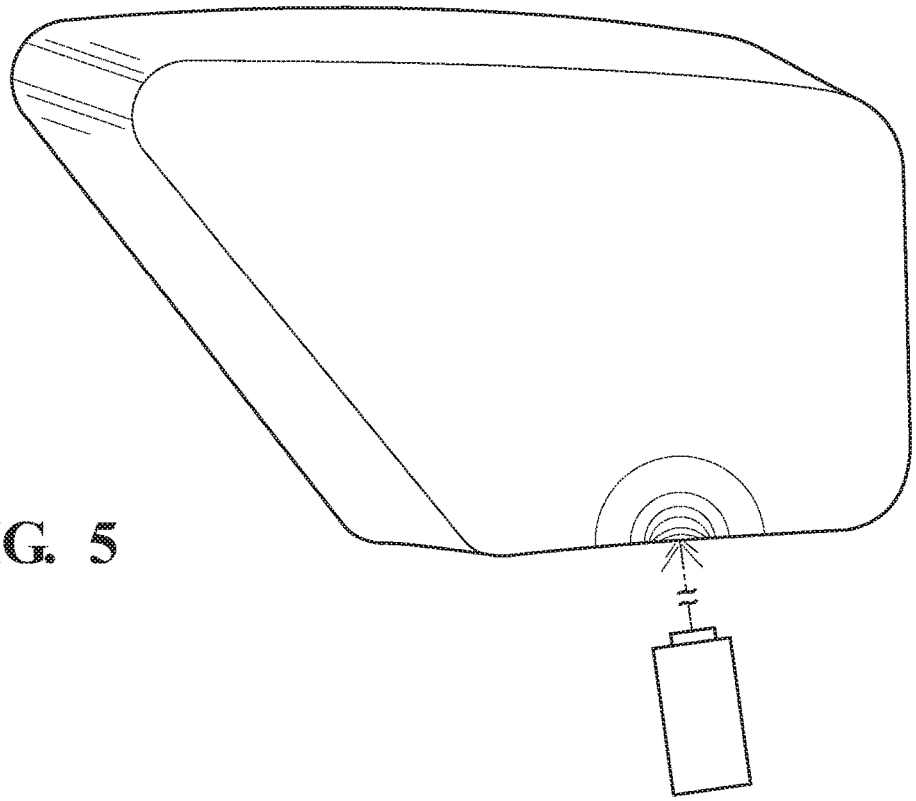
FIG. 5 is an expanded cross section of the core in which a laser is utilized to form an outer skin to allow the core to be self-supportive during the firing process.
Figure 6:
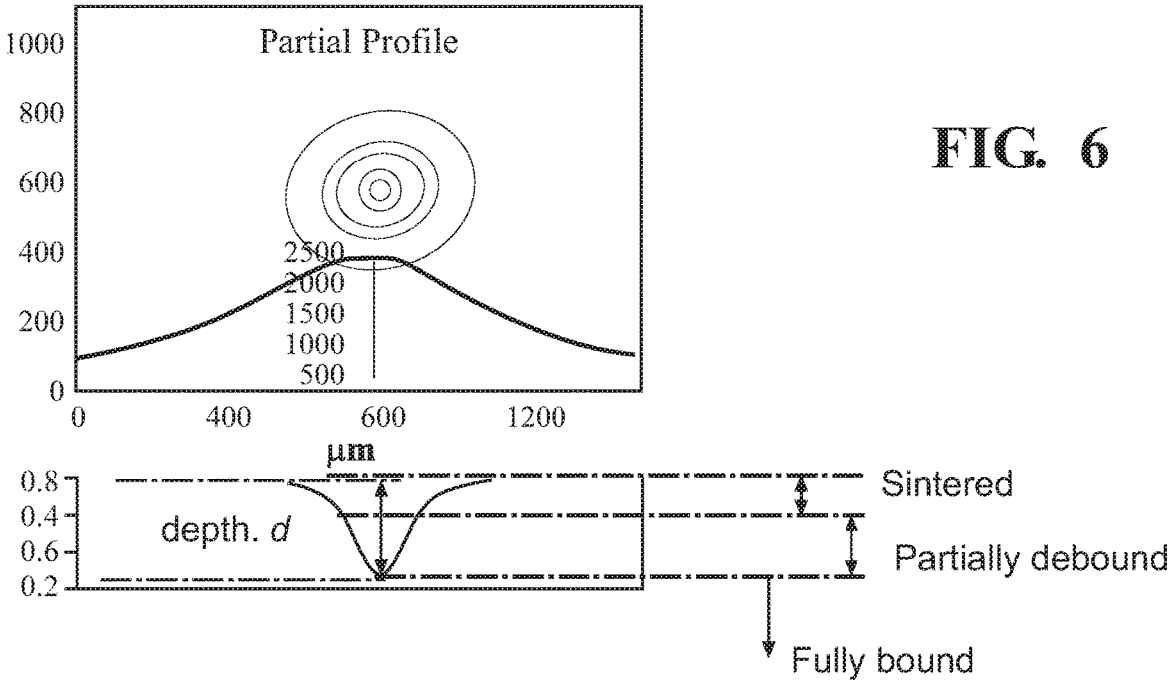
FIG. 6 is a graphical representation of the laser depth effect on the core.

In one example, the transient thermal results of the core 200 under laser heating using a 100 W laser source for 0.050 seconds (FIG. 5). As is visible in the results, the local heating penetrates a shallow depth into the part leaving the larger portion deeper into the core un-affected (FIG. 6). This local heating reduces thermal strains in the part and reduces the risk of core cracking that a deeper heat penetration would produce.

In this embodiment the laser is directed at the core 200 such that only the visibly exposed surfaces are impacted by the laser. That is, the laser only affects the portion of the core 200 that is within line-of-sight of the laser. That is, the outer skin 400 in which the sintering need not fully encapsulate the component, i.e., the laser does not raster the entire surface, for the process to provide structural rigidity during firing.

The pre-sintered portions of the outer skin 400 provide retaining strength to the core 200 during the full furnace burn out process which thereby eliminates the need for setters and reduced development time for processing of a new additive core design. The process facilitates an increase in core yield by strengthening cores prior to firing by pre-sintering the surface and thereby decreases cost for processing of additive cores.

The use of the terms "a," "an," "the," and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other. It should be appreciated that relative positional terms such as "forward," "aft," "upper," "lower," "above," "below," and the like are with reference to the normal operational attitude of the vehicle and should not be considered otherwise limiting.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

It should be appreciated that like reference numerals identify corresponding or similar elements throughout the several drawings. It should also be appreciated that although a particular component arrangement is disclosed in the illustrated embodiment, other arrangements will benefit herefrom.

Although particular step sequences are shown, described, and claimed, it should be appreciated that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be appreciated that within the scope of the appended claims, the disclosure may be practiced other than as specifically described. For that reason the appended claims should be studied to determine true scope and content.

What is claimed is:

1. A method of manufacturing a precursor for casting a component, comprising:

additively manufacturing a precursor body for at least partially forming an internal passage architecture of a component; and forming an outer skin on the additively manufactured precursor body in which an additively manufacturing binder is locally eliminated, the outer skin forming only a visible region of the outer surface of the precursor body such that the outer skin is sintered to retain the shape of the precursor body during a firing process that de-binds and sinters non-outer skin regions of the precursor body; and firing the precursor body to de-bind and sinter the non-outer skin regions of the precursor body subsequent to forming the outer skin.

2. The method as recited in claim 1, further comprising using a directional energy source to form the outer skin.

3. The method as recited in claim 1, further comprising using a laser to form the outer skin.

4. The method as recited in claim 3, wherein the laser is a 100 W laser source that is operated for 0.050 seconds.

5. The method as recited in claim 1, further comprising forming the outer skin only along a line of sight from a directional energy source of the outer surface of the precursor body.

6. The method as recited in claim 5, wherein the visible region is along the line of sight from a directional energy source directed at an outer surface of the precursor body.

7. The method as recited in claim 1, wherein the non-outer skin regions of the precursor body are visually shielded regions of the precursor body.

* * * * *